US011056256B2

(12) United States Patent
Oda et al.

(10) Patent No.: US 11,056,256 B2
(45) **Date of Patent: *Jul. 6, 2021**

(54) NON-ORIENTED ELECTRICAL STEEL SHEET AND METHOD OF PRODUCING SAME

(71) Applicant: JFE STEEL CORPORATION, Tokyo (JP)

(72) Inventors: Yoshihiko Oda, Tokyo (JP); Tomoyuki Okubo, Tokyo (JP); Yoshiaki Zaizen, Tokyo (JP); Masanori Uesaka, Tokyo (JP); Tatsuhiko Hiratani, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 113 days.

This patent is subject to a terminal disclaimer.

(21) Appl. No.: 16/343,847

(22) PCT Filed: Aug. 30, 2017

(86) PCT No.: PCT/JP2017/031117

§ 371 (c)(1),
(2) Date: Apr. 22, 2019

(87) PCT Pub. No.: WO2018/079059

PCT Pub. Date: May 3, 2018

(65) Prior Publication Data

US 2019/0244735 A1 Aug. 8, 2019

(30) Foreign Application Priority Data

Oct. 27, 2016 (JP) ..... JP2016-211044

(51) Int. Cl.
*H01F 1/147* (2006.01)
*C21D 8/12* (2006.01)
(Continued)

(52) U.S. Cl.
CPC ..... *H01F 1/14775* (2013.01); *C21D 8/12* (2013.01); *C21D 8/1222* (2013.01);
(Continued)

(58) Field of Classification Search
CPC ..... C21D 8/12; C21D 8/1222; C21D 8/1233; C22C 38/00; C22C 38/02; C22C 38/04;
(Continued)

(56) References Cited

U.S. PATENT DOCUMENTS 6,340,399 B1 1/2002 Tanaka et al.
6,436,199 B1 8/2002 Hayakawa et al.
(Continued)

FOREIGN PATENT DOCUMENTS

CN 1278016 A 12/2000
CN 103305659 A 9/2013
(Continued)

OTHER PUBLICATIONS

Aug. 19, 2019, the Extended European Search Report issued by the European Patent Office in the corresponding European Patent Application No. 17863904.3.
(Continued)

*Primary Examiner* — Jenny R Wu
(74) *Attorney, Agent, or Firm* — Kenja IP Law PC

(57) ABSTRACT

Iron loss is reduced by increasing magnetic flux density. Disclosed is a non-oriented electrical steel sheet has a chemical composition containing, by mass %, C: 0.0050% or less, Si: 1.50% or more and 4.00% or less, Al: 0.500% or less, Mn: 0.10% or more and 5.00% or less, S: 0.0200% or less, P: 0.200% or less, N: 0.0050% or less, O: 0.0200% or less, and Ca: 0.0010% or more and 0.0050% or less, with the balance being Fe and inevitable impurities, in which the non-oriented electrical steel sheet has an $Ar_3$ transformation temperature of 700° C. or higher, a grain size of 80 μm or
(Continued)

more and 200 μm or less, and a Vickers hardness of 140 HV or more and 230 HV or less.

8 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/00*** | (2006.01) |
| ***C22C 38/14*** | (2006.01) |

(52) U.S. Cl.
CPC ..... *C21D 8/1233* (2013.01); *C22C 38/00* (2013.01); *C22C 38/02* (2013.01); *C22C 38/04* (2013.01); *C22C 38/06* (2013.01); *C22C 38/14* (2013.01); *H01F 1/147* (2013.01)

(58) Field of Classification Search
CPC ..... C22C 38/06; C22C 38/14; H01F 1/147; H01F 1/14775
See application file for complete search history.

(56) References Cited

U.S. PATENT DOCUMENTS

| | | | | |
|---|---|---|---|---|
| 6,503,339 | B1 | 1/2003 | Pircher et al. | |
| 7,501,028 | B2 | 3/2009 | Hammer et al. | |
| 8,097,094 | B2 | 1/2012 | Murakami | |
| 9,947,446 | B2 | 4/2018 | Toda et al. | |
| 10,006,109 | B2 | 6/2018 | Nakanishi et al. | |
| 10,147,528 | B2 | 12/2018 | Zhang et al. | |
| 2002/0043299 | A1 | 4/2002 | Tanaka et al. | |
| 2004/0149355 | A1* | 8/2004 | Kohno | C22C 38/008 148/111 |
| 2008/0121314 | A1 | 5/2008 | Choi et al. | |
| 2014/0238558 | A1 | 8/2014 | Fujikura et al. | |
| 2015/0318093 | A1 | 11/2015 | Hill et al. | |
| 2017/0009316 | A1 | 1/2017 | Yamazake et al. | |
| 2018/0001369 | A1 | 1/2018 | Senda et al. | |
| 2018/0355450 | A1* | 12/2018 | Lee | C22C 38/02 |
| 2019/0244735 | A1 | 8/2019 | Oda et al. | |

FOREIGN PATENT DOCUMENTS

| | | | | |
|---|---|---|---|---|
| CN | 104781435 | A | | 7/2015 |
| CN | 105452514 | A | | 3/2016 |
| JP | H10251752 | A | | 9/1998 |
| JP | 2000129410 | A | | 5/2000 |
| JP | 2001316729 | A | * | 11/2001 |
| JP | 2001323352 | A | | 11/2001 |
| JP | 2002504624 | A | | 2/2002 |
| JP | 2005525469 | A | | 8/2005 |
| JP | 2013044009 | A | | 3/2013 |
| JP | 2014195818 | A | * | 10/2014 |
| JP | 2014195818 | A | | 10/2014 |
| JP | 5716315 | B2 | | 5/2015 |
| JP | 5853983 | B2 | | 2/2016 |
| JP | 2016129902 | A | | 7/2016 |
| TW | 200403346 | A | | 3/2004 |
| WO | 2015129199 | A1 | | 9/2015 |
| WO | 2016114212 | A1 | | 7/2016 |

OTHER PUBLICATIONS

Nov. 18, 2019, Office Action issued by the United States Patent and Trademark Office in the U.S. Appl. No. 15/743,776.
Calphad, The Metastable Iron-Carbon (Fe—C) Phase Diagram, 2007. Computational Thermodynamics Inc. (Year: 2007).
Aug. 7, 2018, Notification of Reasons for Refusal issued by the Japan Patent Office in the corresponding Japanese Patent Application No. 2017-566158, with English language Concise Statement of Relevance.
Dec. 5, 2017, International Search Report issued in the International Patent Application No. PCT/JP2017/031117.
Mar. 22, 2018, Office Action issued by the Taiwan Intellectual Property Office in the corresponding Taiwanese Patent Application No. 106130902, with English language Search Report.
Feb. 21, 2020, Office Action issued by the United States Patent and Trademark Office in the U.S. Appl. No. 15/743,776.
May 27, 2020, Office Action issued by the United States Patent and Trademark Office in the U.S. Appl. No. 15/743,776.
Guanghui Yang et al., Shape control and detection of hot rolled steel, Jul. 31, 2015, p. 274.
Fengxi Lu et al., Cold-rolled silicon steel production technology abroad, Mar. 31, 2013, p. 16.
Jul. 21, 2020, Office Action issued by the China National Intellectual Property Administration in the corresponding Chinese Patent Application No. 201780066118.6 with English language concise statement of relevance.
Oct. 5, 2020, Communication pursuant to Article 94(3) EPC issued by the European Patent Office in the corresponding European Patent Application No. 17863904.3.
Jan. 27, 2021, Office Action issued by the United States Patent and Trademark Office in the U.S. Appl. No. 16/476,937.

* cited by examiner

NON-ORIENTED ELECTRICAL STEEL SHEET AND METHOD OF PRODUCING SAME

TECHNICAL FIELD

This disclosure relates to a non-oriented electrical steel sheet and a method of producing the same.

BACKGROUND

Recently, high efficiency induction motors are being used to meet increasing energy saving needs in factories. To improve efficiency of such motors, attempts are being made to increase a thickness of an iron core lamination and improve the winding filling factor thereof. Further attempts are being made to replace a conventional low grade material with a higher grade material having low iron loss properties as an electrical steel sheet used for iron cores.

Additionally, from the viewpoint of reducing copper loss, such core materials for induction motors are required to have low iron loss properties and to lower the exciting effective current at the designed magnetic flux density. In order to reduce the exciting effective current, it is effective to increase the magnetic flux density of the core material.

Further, in the case of drive motors of hybrid electric vehicles, which have been rapidly spreading recently, high torque is required at the time of starting and accelerating, and thus further improvement of magnetic flux density is desired.

As an electrical steel sheet having a high magnetic flux density, for example, JP2000129410A (PTL 1) describes a non-oriented electrical steel sheet made of a steel to which Si is added at 4% or less and Co at 0.1% or more and 5% or less. However, since Co is very expensive, leading to the problem of a significant increase in cost when applied to a general motor.

On the other hand, use of a material with a low Si content makes it possible to increase the magnetic flux density, yet such a material is soft, and experiences a significant increase in iron loss when punched into a motor core material.

CITATION LIST

Patent Literature

PTL 1: JP2000129410A

SUMMARY

Technical Problem

Under these circumstances, there is a demand for a technique for increasing the magnetic flux density of an electrical steel sheet and reducing the iron loss without causing a significant increase in cost.

It would thus be helpful to provide a non-oriented electrical steel sheet with high magnetic flux density and low iron loss, and a method of producing the same.

Solution to Problem

As a result of extensive investigations on the solution of the above problems, the inventors have found that by adjusting the chemical composition such that it allows for $\gamma \rightarrow \alpha$ transformation (transformation from $\gamma$ phase to $\alpha$ phase) during hot rolling and by setting the Vickers hardness to 140 HV or more and 230 HV or less, it is possible to obtain a material with an improved balance between its magnetic flux density and iron loss properties without performing hot band annealing.

The present disclosure was completed based on these findings, and the primary features thereof are as described below.

1. A non-oriented electrical steel sheet comprising a chemical composition containing (consisting of), by mass %, C: 0.0050% or less, Si: 1.50% or more and 4.00% or less, Al: 0.500% or less, Mn: 0.10% or more and 5.00% or less, S: 0.0200% or less, P: 0.200% or less, N: 0.0050% or less, O: 0.0200% or less, and Ca: 0.0010% or more and 0.0050% or less, with the balance being Fe and inevitable impurities, wherein the non-oriented electrical steel sheet has an $Ar_3$ transformation temperature of 700° C. or higher, a grain size of 80 μm or more and 200 μm or less, and a Vickers hardness of 140 HV or more and 230 HV or less.

2. The non-oriented electrical steel sheet according to 1., wherein the chemical composition further contains, by mass %, Ni: 0.010% or more and 3.000% or less.

3. The non-oriented electrical steel sheet according to 1. or 2., wherein the chemical composition further contains, by mass %, Ti: 0.0030% or less, Nb: 0.0030% or less, V: 0.0030% or less, and Zr: 0.0020% or less.

4. A method of producing the non-oriented electrical steel sheet as recited in any one of 1. to 3., the method comprising performing hot rolling in at least one pass in a dual-phase region of from $\gamma$-phase and $\alpha$-phase.

Advantageous Effect

According to the disclosure, it is possible to obtain an electrical steel sheet with high magnetic flux density and low iron loss.

DETAILED DESCRIPTION

The reasons for the limitations of the disclosure will be described below.

Firstly, in order to investigate the influence of the dual-phase region on the magnetic properties, Steel A to Steel C having the chemical compositions listed in Table 1 were prepared by steelmaking to obtain slabs in a laboratory, and the slabs were hot rolled. The hot rolling was performed in 7 passes, where the entry temperature in the first pass (F1) was adjusted to 1030° C. and the entry temperature in the final pass (F7) to 910° C.

TABLE 1

| Steel | Chemical composition (mass %) | | | | | | | | | | | | | |
|---|---|---|---|---|---|---|---|---|---|---|---|---|---|---|
| | C | Si | Al | Mn | P | S | N | O | Ni | Ca | Ti | V | Zr | Nb |
| A | 0.0016 | 1.40 | 0.400 | 0.20 | 0.010 | 0.0004 | 0.0020 | 0.0020 | 0.10 | 0.0031 | 0.0010 | 0.0010 | 0.0005 | 0.0005 |
| B | 0.0018 | 1.30 | 0.300 | 0.30 | 0.010 | 0.0008 | 0.0022 | 0.0020 | 0.10 | 0.0032 | 0.0010 | 0.0010 | 0.0004 | 0.0005 |
| C | 0.0017 | 2.00 | 0.001 | 0.80 | 0.010 | 0.0007 | 0.0022 | 0.0045 | 0.10 | 0.0030 | 0.0010 | 0.0010 | 0.0005 | 0.0003 |

After being pickled, each hot rolled sheet was cold rolled to a sheet thickness of 0.35 mm, and then subjected to final annealing at 950° C. for 10 seconds in a 20% $H_2$-80% $N_2$ atmosphere.

Figure 1:
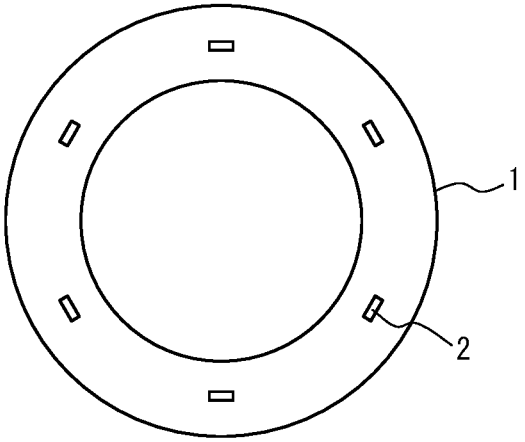
FIG. 1 is a schematic view of a caulking ring sample.

From each final annealed sheet thus obtained, a ring sample 1 having an outer diameter of 55 mm and an inner diameter of 35 mm was prepared by punching, V caulking 2 was applied at six equally spaced positions of the ring sample 1 as illustrated in FIG. 1, and 10 ring samples 1 were stacked and fixed together into a stacked structure. Magnetic property measurement was performed using the stacked structure with windings of the first 100 turns and the second 100 turns, and the measurement results were evaluated using a wattmeter. The Vickers hardness was measured in accordance with JIS Z2244 by pushing a 500 g diamond indenter into a cross section in the rolling direction of each steel sheet. The grain size was measured in accordance with JIS G0551 after polishing the cross section and etching with nital.

The measurement results of the magnetic properties and Vickers hardness of Steel A to Steel C in Table 1 are listed in Table 2. Focusing attention on the magnetic flux density, it is understood that the magnetic flux density is low in Steel A and high in Steels B and C. In order to identify the cause, we investigated the texture of the material after final annealing, and it was revealed that the (111) texture which is disadvantageous to the magnetic properties was developed in Steel A as compared with Steels B and C. It is known that the microstructure of the electrical steel sheet before cold rolling has a large influence on the texture formation in the electrical steel sheet, and investigation was made on the microstructure after hot rolling, and it was found that Steel A had a non-recrystallized microstructure. For this reason, it is considered that in Steel A, a (111) texture was developed during the cold rolling and final annealing process after the hot rolling.

TABLE 2

| Steel | Magnetic flux density $B_{50}$ (T) | Iron loss $W_{15/50}$ (W/kg) | HV | Grain size (μm) |
|---|---|---|---|---|
| A | 1.64 | 3.40 | 145 | 121 |
| B | 1.69 | 4.00 | 135 | 120 |
| C | 1.69 | 2.60 | 155 | 122 |

We also observed the microstructures of Steels B and C after subjection to the hot rolling, and found that the microstructures were completely recrystallized. It is thus considered that in Steels B and C, formation of a (111) texture disadvantageous to the magnetic properties was suppressed and the magnetic flux density increased.

As described above, in order to identify the cause of varying microstructures after hot rolling among different steels, transformation behavior during hot rolling was evaluated by linear expansion coefficient measurement. As a result, it was revealed that Steel A has a single α-phase from the high temperature range to the low temperature range, and that no phase transformation occurred during the hot rolling. On the other hand, it was revealed that the $Ar_3$ transformation temperature was 1020° C. for Steel B and 930° C. for Steel C, and that γ→α transformation occurred in the first pass in Steel B and in the third to fifth passes in Steel C. It is considered that the occurrence of γ→α transformation during the hot rolling caused the recrystallization to proceed with the transformation strain as the driving force.

From the above, it is important to have γ→α transformation in the temperature range where hot rolling is performed. Therefore, the following experiment was conducted to identify the $Ar_3$ transformation temperature at which γ→α transformation should be completed. Specifically, steels, each containing C: 0.0016%, Al: 0.001%, P: 0.010%, S: 0.0008%, N: 0.0020%, O: 0.0050% to 0.0070%, Ni: 0.100%, Ca: 0.0029%, Ti: 0.0010%, V: 0.0010%, Zr: 0.0005%, and Nb: 0.0004% as basic components, with the balance between the Si and Mn contents changed to alter the $Ar_3$ transformation temperatures, were prepared by steelmaking in a laboratory and formed into slabs. The slabs thus obtained were hot rolled. The hot rolling was performed in 7 passes, where the entry temperature in the first pass (F1) was adjusted to 900° C. and the entry temperature in the final pass (F7) to 780° C., such that at least one pass of the hot rolling was performed in a dual-phase region of α-phase and γ-phase.

After being pickled, each hot rolled sheet was cold rolled to a sheet thickness of 0.35 mm, and then subjected to final annealing at 950° C. for 10 seconds in a 20% $H_2$-80% $N_2$ atmosphere.

From each final annealed sheet thus obtained, a ring sample 1 having an outer diameter of 55 mm and an inner diameter of 35 mm was prepared by punching, V caulking 2 was applied at six equally spaced positions of the ring sample 1 as illustrated in FIG. 1, and 10 ring samples 1 were stacked and fixed together into a stacked structure. Magnetic property measurement was performed using the stacked structure with windings of the first 100 turns and the second 100 turns, and the measurement results were evaluated using a wattmeter.

Figure 2:
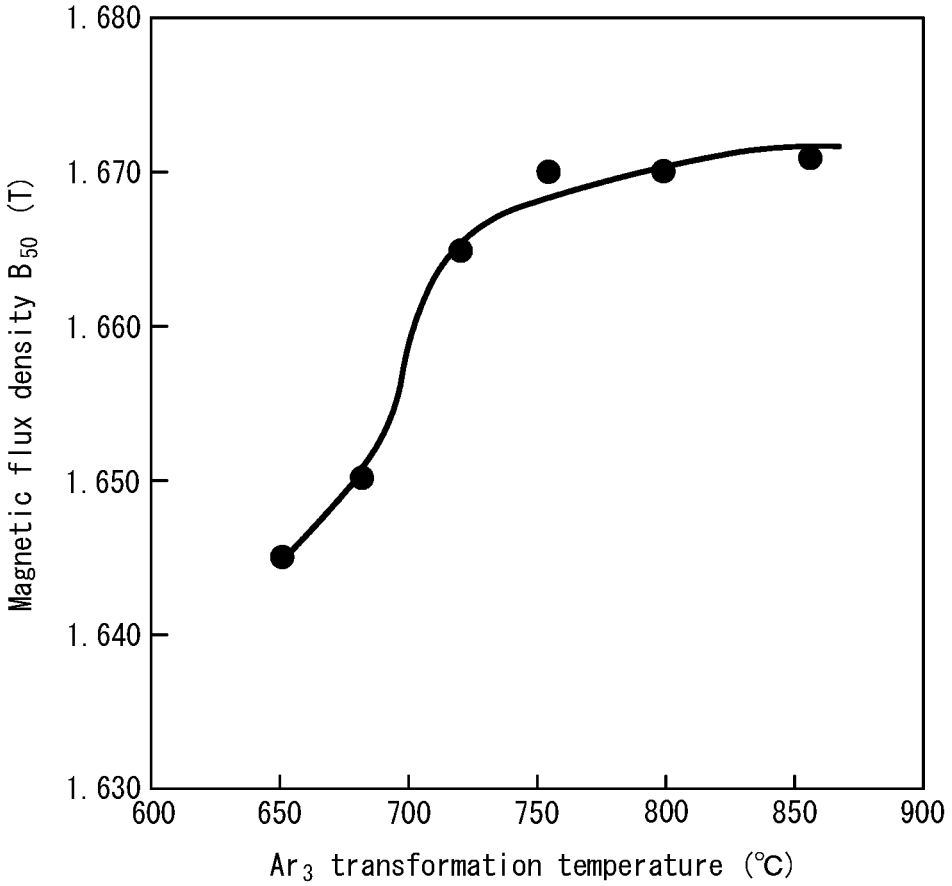
FIG. 2 is a graph illustrating the influence of $Ar_3$ transformation temperature on magnetic flux density $B_{50}$.

FIG. 2 illustrates the influence of the $Ar_3$ transformation temperature on the magnetic flux density $B_{50}$. It can be seen that when the $Ar_3$ transformation temperature is below 700° C., the magnetic flux density $B_{50}$ decreases. Although the reason is not clear, it is considered to be that when the $Ar_3$ transformation temperature was below 700° C., the grain size before cold rolling was so small that it caused a (111) texture disadvantageous to the magnetic properties to develop during the process from the subsequent cold rolling to final annealing.

In view of the above, the $Ar_3$ transformation temperature is set to 700° C. or higher. It is preferably set to 730° C. or higher from the viewpoint of magnetic flux density. No upper limit is placed on the $Ar_3$ transformation temperature. However, it is important that γ→α transformation is caused to occur during hot rolling, and at least one pass of the hot rolling needs to be performed in a dual-phase region of γ-phase and α-phase. In view of this, it is preferable that the $Ar_3$ transformation temperature is set to 1000° C. or lower. This is because performing hot rolling during transformation promotes development of a texture which is preferable for the magnetic properties.

Focusing on the evaluation of iron loss in Table 2 above, it can be seen that iron loss is low in Steels A and C and high in Steel B. Although the cause is not clear, it is considered to be that since the hardness (HV) of the steel sheet after final annealing was low in Steel B, a compressive stress field generated by punching and caulking was spread easily and iron loss increased. Therefore, the Vickers hardness of the steel sheet is set to 140 HV or more, and preferably 150 HV or more. On the other hand, a Vickers hardness above 230 HV wears the mold more severely, which unnecessarily increases the cost. Therefore, the upper limit is set to 230 HV, and preferably 200 HV or less. In addition, to provide a Vickers hardness of 140 HV or more and 230 HV or less, it is necessary to appropriately add a solid-solution-strengthening element such as Si, Mn, or P. The Vickers hardness was measured in accordance with JIS Z2244 by pushing a 500 g diamond indenter into a cross section in the rolling direction of each steel sheet. The grain size was measured in accordance with JIS G0551 after polishing the cross section and etching with nital.

The following describes a non-oriented electrical steel sheet according to one of the disclosed embodiments. Firstly, the reasons for limitations on the chemical composition of steel will be explained. When components are expressed in "%", this refers to "mass %" unless otherwise specified.

C: 0.0050% or Less

C content is set to 0.0050% or less from the viewpoint of preventing magnetic aging. On the other hand, since C has an effect of improving the magnetic flux density, the C content is preferably 0.0010% or more.

Si: 1.50% or More and 4.00% or Less

Si is a useful element for increasing the specific resistance of a steel sheet. Thus, the Si content is preferably set to 1.50% or more. On the other hand, Si content exceeding 4.00% results in a decrease in saturation magnetic flux density and an associated decrease in magnetic flux density. Thus, the upper limit for the Si content is set to 4.00%. The Si content is preferably 3.00% or less. This is because, if the Si content exceeds 3.00%, it is necessary to add a large amount of Mn in order to obtain a dual-phase region, which unnecessarily increases the cost.

Al: 0.500% or Less

Al is a γ-region closed type element, and a lower Al content is preferable. The Al content is set to 0.500% or less, preferably 0.020% or less, and more preferably 0.002% or less. Note that the Al content generally does not drop below 0.0005% since reducing it below 0.0005% is difficult in production on an industrial scale, and 0.0005% is acceptable in the present disclosure.

Mn: 0.10% or More and 5.00% or Less

Since Mn is an effective element for enlarging the γ region, the lower limit for the Mn content is set at 0.10%. On the other hand, a Mn content exceeding 5.00% results in a decrease in magnetic flux density. Thus, the upper limit for the Mn content is set at 5.00%. The Mn content is preferably 3.00% or less. The reason is that a Mn content exceeding 3.00% unnecessarily increases the cost.

S: 0.0200% or Less

S causes an increase in iron loss due to precipitation of MnS if added beyond 0.0200%. Thus, the upper limit for the S content is set at 0.0200%. Note that the S content generally does not drop below 0.0001% since reducing it below 0.0001% is difficult in production on an industrial scale, and 0.0001% is acceptable in the present disclosure.

P: 0.200% or Less

P increases the hardness of the steel sheet if added beyond 0.200%. Thus, the P content is set to 0.200% or less, and more preferably 0.100% or less. Further preferably, the P content is set to 0.010% or more and 0.050% or less. This is because P has the effect of suppressing nitridation by surface segregation.

N: 0.0050% or Less

N causes more MN precipitation and increases iron loss if added in a large amount. Thus, the N content is set to 0.0050% or less. Note that the N content generally does not drop below 0.0005% since reducing it below 0.0005% is difficult in production on an industrial scale, and 0.0005% is acceptable in the present disclosure.

O: 0.0200% or Less

O causes more oxides and increases iron loss if added in a large amount. Thus, the O content is set to 0.0200% or less. Note that the O content generally does not drop below 0.0010% since reducing it below 0.0010% is difficult in production on an industrial scale, and 0.0010% is acceptable in the present disclosure.

Ca: 0.0010% or More and 0.0050% or Less

Ca can fix sulfides as CaS and reduce iron loss. Therefore, the upper limit for the Ca content is set at 0.0010%. On the other hand, if it exceeds 0.0050%, a large amount of CaS is precipitated and the iron loss increases. Therefore, the upper limit is set at 0.0050%. In order to stably reduce the iron loss, the Ca content is preferably set to 0.0015% or more and 0.0035% or less.

The basic components of the steel sheet according to the disclosure have been described. The balance other than the above components consist of Fe and inevitable impurities. However, the following optional elements may also be added as appropriate.

Ni: 0.010% or More and 3.000% or Less

Since Ni is an effective element for enlarging the γ region, the lower limit for the Ni content is set at 0.010%. On the other hand, a Ni content exceeding 3.000% unnecessarily increases the cost. Therefore, the upper limit is set at 3.000%, and a more preferable range is from 0.100% to 1.000%. Note that Ni may be 0%.

In the chemical composition, it is preferable to suppress the Ti, Nb, V, and Zr contents by mass % such that Ti: 0.0030% or less, Nb: 0.0030% or less, V: 0.0030% or less, and Zr: 0.0020% or less, and all of these components shall not exceed the specified upper limits, respectively.

Ti: 0.0030% or Less

Ti causes more TiN precipitation and may increase iron loss if added in a large amount. Thus, the Ti content is set to 0.0030% or less. Note that Ti may be 0%.

Nb: 0.0030% or Less

Nb causes more NbC precipitation and may increase iron loss if added in a large amount. Thus, the Nb content is set to 0.0030% or less. Note that Nb may be 0%.

V: 0.0030% or Less

V causes more VN and VC precipitation and may increase iron loss if added in a large amount. Thus, the V content is set to 0.0030% or less. Note that V may be 0%.

Zr: 0.0020% or Less

Zr causes more ZrN precipitation and may increase iron loss if added in a large amount. Thus, the Zr content is set to 0.0020% or less. Note that Zr may be 0%.

Next, the steel microstructure will be described.

The average grain size is set to 80 μm or more and 200 μm or less. If the average grain size is less than 80 μm, the Vickers hardness can indeed be adjusted to 140 HV or more in the case of a low-Si material. This small grain size, however, would increase the iron loss. Therefore, the grain size is set to 80 μm or more. On the other hand, when the grain size exceeds 200 μm, plastic deformation due to punching and caulking increases, resulting in increased iron loss. Therefore, the upper limit for the grain size is set at 200 μm. Here, the average grain size is measured according to JIS G0051 after polishing the cross section in the rolling direction of the steel sheet and etching with nital. To obtain a grain size of 80 μm or more and 200 μm or less, it is necessary to appropriately control the final annealing temperature. That is, by setting the final annealing temperature in the range of 900° C. to 1050° C., it is possible to control the grain size to a predetermined value. In addition, the average grain size is preferably 100 μm or more and 150 μm or less from the viewpoint of iron loss.

The following provides a specific description of the conditions for producing the non-oriented electrical steel sheet according to the disclosure.

The non-oriented electrical steel sheet according to the disclosure may be produced otherwise following a conventional method of producing a non-oriented electrical steel sheet as long as the chemical composition and the hot rolling conditions specified herein are within predetermined ranges. That is, molten steel is subjected to blowing in the converter and degassing treatment where it is adjusted to a predetermined chemical composition, and subsequently to casting to obtain a slab, and the slab is hot rolled. The finisher delivery temperature and the coiling temperature during hot rolling are not particularly specified, yet it is necessary to perform at least one pass of the hot rolling in a dual-phase region of γ-phase and α-phase. The coiling temperature is preferably set to 650° C. or lower in order to prevent oxidation during coiling. According to the present disclosure, excellent magnetic properties can be obtained without hot band annealing. However, hot band annealing may be carried out. Then, the steel sheet is subjected to cold rolling once, or twice or more with intermediate annealing performed therebetween, to a predetermined sheet thickness, and to the subsequent final annealing according to the above-mentioned conditions.

EXAMPLES

Molten steels were blown in the converter, degassed, smelted to the compositions listed in Table 3, and cast into slabs. Then, each steel slab was subjected to slab heating at 1120° C. for 1 hour and hot rolled to obtain a hot-rolled steel sheet having a sheet thickness of 2.0 mm. The hot finish rolling was performed in 7 passes, the entry temperature in the first pass and the entry temperature in the final pass were set as listed in Table 3, and the coiling temperature was set to 650° C. Thereafter, each steel sheet was pickled and cold rolled to a sheet thickness of 0.35 mm. Each steel sheet thus obtained was subjected to final annealing in a 20% $H_2$-80% $N_2$ atmosphere under the conditions listed in Table 3 with an annealing time of 10 seconds. Then, the magnetic properties ($W_{15/50}$, $B_{50}$) and hardness (HV) were evaluated. In the magnetic property measurement, Epstein samples were cut in the rolling direction and the transverse direction (direction orthogonal to the rolling direction) from each steel sheet, and Epstein measurement was performed. The Vickers hardness was measured in accordance with JIS Z2244 by pressing a 500 g diamond indenter into a cross section in the transverse direction of each steel sheet. The grain size was measured in accordance with JIS G0551 after polishing the cross section and etching with nital.

TABLE 3

| | Chemical composition (mass %) | | | | | | | | | | | | | | $Ar_1$ | $Ar_3$ |
|---|---|---|---|---|---|---|---|---|---|---|---|---|---|---|---|---|
| No. | C | Si | Mn | P | S | Al | Ca | Ni | Ti | V | Zr | Nb | O | N | (° C.) | (° C.) |
| 1 | 0.0016 | 1.45 | 0.15 | 0.020 | 0.0019 | 0.500 | 0.0020 | 0.020 | 0.0002 | 0.0007 | 0.0001 | 0.0002 | 0.0012 | 0.0012 | — | — |
| 2 | 0.0019 | 1.29 | 0.18 | 0.031 | 0.0018 | 0.200 | 0.0020 | 0.020 | 0.0002 | 0.0007 | 0.0001 | 0.0002 | 0.0013 | 0.0015 | 1080 | 1020 |
| 3 | 0.0015 | 1.65 | 0.25 | 0.045 | 0.0013 | 0.001 | 0.0002 | 0.200 | 0.0002 | 0.0007 | 0.0001 | 0.0002 | 0.0030 | 0.0016 | 1010 | 950 |
| 4 | 0.0014 | 1.65 | 0.25 | 0.045 | 0.0013 | 0.001 | 0.0020 | 0.200 | 0.0002 | 0.0006 | 0.0001 | 0.0002 | 0.0030 | 0.0016 | 1010 | 950 |
| 5 | 0.0015 | 1.54 | 0.30 | 0.045 | 0.0013 | 0.001 | 0.0020 | 0.400 | 0.0002 | 0.0007 | 0.0001 | 0.0002 | 0.0030 | 0.0017 | 1010 | 950 |
| 6 | 0.0016 | 1.81 | 0.51 | 0.020 | 0.0013 | 0.001 | 0.0020 | 0.150 | 0.0002 | 0.0007 | 0.0001 | 0.0002 | 0.0030 | 0.0020 | 990 | 930 |
| 7 | 0.0016 | 1.81 | 0.50 | 0.020 | 0.0013 | 0.002 | 0.0020 | 0.150 | 0.0002 | 0.0007 | 0.0001 | 0.0002 | 0.0030 | 0.0021 | 1001 | 941 |
| 8 | 0.0020 | 1.81 | 0.50 | 0.020 | 0.0013 | 0.004 | 0.0020 | 0.150 | 0.0002 | 0.0006 | 0.0001 | 0.0002 | 0.0030 | 0.0019 | 1001 | 941 |
| 9 | 0.0019 | 1.29 | 0.30 | 0.030 | 0.0013 | 0.001 | 0.0020 | 0.300 | 0.0002 | 0.0007 | 0.0001 | 0.0002 | 0.0030 | 0.0018 | 990 | 930 |
| 10 | 0.0019 | 1.42 | 0.30 | 0.030 | 0.0013 | 0.001 | 0.0020 | 0.300 | 0.0002 | 0.0007 | 0.0001 | 0.0002 | 0.0030 | 0.0017 | 1000 | 940 |
| 11 | 0.0018 | 2.01 | 0.80 | 0.010 | 0.0013 | 0.001 | 0.0020 | 0.300 | 0.0002 | 0.0006 | 0.0001 | 0.0002 | 0.0030 | 0.0022 | 980 | 920 |
| 12 | 0.0016 | 2.51 | 1.20 | 0.010 | 0.0017 | 0.001 | 0.0020 | 0.300 | 0.0002 | 0.0007 | 0.0001 | 0.0002 | 0.0030 | 0.0020 | 970 | 910 |
| 13 | 0.0019 | 3.13 | 1.60 | 0.010 | 0.0016 | 0.001 | 0.0020 | 0.300 | 0.0002 | 0.0007 | 0.0001 | 0.0002 | 0.0030 | 0.0016 | 970 | 910 |
| 14 | 0.0016 | 2.05 | 2.00 | 0.010 | 0.0015 | 0.001 | 0.0020 | 0.300 | 0.0002 | 0.0006 | 0.0001 | 0.0002 | 0.0030 | 0.0022 | 880 | 820 |
| 15 | 0.0020 | 2.01 | 3.00 | 0.010 | 0.0016 | 0.001 | 0.0020 | 0.020 | 0.0010 | 0.0007 | 0.0001 | 0.0003 | 0.0030 | 0.0020 | 790 | 730 |
| 16 | 0.0017 | 4.61 | 3.00 | 0.010 | 0.0014 | 0.001 | 0.0020 | 0.020 | 0.0003 | 0.0007 | 0.0001 | 0.0002 | 0.0030 | 0.0021 | 920 | 860 |
| 17 | 0.0015 | 2.03 | 3.50 | 0.010 | 0.0012 | 0.001 | 0.0020 | 0.020 | 0.0010 | 0.0007 | 0.0001 | 0.0003 | 0.0030 | 0.0017 | 740 | 680 |
| 18 | 0.0014 | 2.51 | 5.60 | 0.032 | 0.0014 | 0.500 | 0.0020 | 0.020 | 0.0005 | 0.0006 | 0.0001 | 0.0005 | 0.0013 | 0.0019 | 780 | 720 |
| 19 | 0.0013 | 1.56 | 0.95 | 0.032 | 0.0018 | 0.300 | 0.0020 | 0.020 | 0.0005 | 0.0007 | 0.0001 | 0.0002 | 0.0010 | 0.0018 | 1060 | 1000 |
| 20 | 0.0016 | 1.70 | 0.95 | 0.032 | 0.0015 | 0.600 | 0.0020 | 0.020 | 0.0005 | 0.0007 | 0.0001 | 0.0002 | 0.0009 | 0.0015 | — | — |
| 21 | 0.0017 | 1.71 | 0.30 | 0.032 | 0.0015 | 0.001 | 0.0020 | 0.020 | 0.0005 | 0.0007 | 0.0001 | 0.0002 | 0.0030 | 0.0015 | 1010 | 950 |
| 22 | 0.0017 | 1.72 | 0.30 | 0.032 | 0.0015 | 0.001 | 0.0020 | 0.020 | 0.0005 | 0.0007 | 0.0001 | 0.0002 | 0.0032 | 0.0016 | 1010 | 950 |
| 23 | 0.0017 | 1.73 | 0.30 | 0.102 | 0.0016 | 0.001 | 0.0020 | 0.020 | 0.0005 | 0.0007 | 0.0001 | 0.0002 | 0.0035 | 0.0015 | 1020 | 960 |
| 24 | 0.0017 | 1.82 | 0.82 | 0.252 | 0.0015 | 0.001 | 0.0020 | 0.020 | 0.0020 | 0.0007 | 0.0001 | 0.0002 | 0.0031 | 0.0022 | 1020 | 960 |
| 25 | 0.0016 | 2.05 | 0.82 | 0.020 | 0.0014 | 0.002 | 0.0035 | 0.020 | 0.0005 | 0.0007 | 0.0001 | 0.0002 | 0.0032 | 0.0021 | 984 | 924 |
| 26 | 0.0015 | 2.05 | 0.82 | 0.021 | 0.0014 | 0.002 | 0.0045 | 0.020 | 0.0005 | 0.0007 | 0.0001 | 0.0002 | 0.0033 | 0.0022 | 985 | 925 |
| 27 | 0.0017 | 2.02 | 0.82 | 0.021 | 0.0016 | 0.002 | 0.0061 | 0.020 | 0.0005 | 0.0007 | 0.0001 | 0.0002 | 0.0032 | 0.0022 | 983 | 923 |
| 28 | 0.0016 | 2.05 | 0.82 | 0.021 | 0.0014 | 0.002 | 0.0035 | 0.005 | 0.0005 | 0.0006 | 0.0001 | 0.0002 | 0.0032 | 0.0021 | 985 | 925 |
| 29 | 0.0016 | 2.05 | 0.82 | 0.021 | 0.0015 | 0.002 | 0.0035 | 0.200 | 0.0005 | 0.0007 | 0.0001 | 0.0002 | 0.0032 | 0.0021 | 985 | 925 |
| 30 | 0.0016 | 2.05 | 0.82 | 0.021 | 0.0013 | 0.002 | 0.0035 | 1.000 | 0.0005 | 0.0007 | 0.0001 | 0.0002 | 0.0032 | 0.0021 | 985 | 925 |
| 31 | 0.0016 | 2.05 | 0.82 | 0.021 | 0.0015 | 0.002 | 0.0035 | 3.600 | 0.0005 | 0.0007 | 0.0001 | 0.0002 | 0.0032 | 0.0021 | 985 | 925 |
| 32 | 0.0015 | 2.30 | 0.51 | 0.052 | 0.0015 | 0.001 | 0.0020 | 0.500 | 0.0025 | 0.0007 | 0.0001 | 0.0002 | 0.0032 | 0.0022 | 990 | 930 |
| 33 | 0.0015 | 2.32 | 0.52 | 0.052 | 0.0015 | 0.001 | 0.0020 | 0.500 | 0.0041 | 0.0007 | 0.0001 | 0.0002 | 0.0032 | 0.0022 | 990 | 930 |

TABLE 3-continued

| | | | | | | | | | | | | | | | | |
|---|---|---|---|---|---|---|---|---|---|---|---|---|---|---|---|---|
| 34 | 0.0016 | 2.35 | 0.50 | 0.052 | 0.0015 | 0.001 | 0.0020 | 0.500 | 0.0006 | 0.0022 | 0.0001 | 0.0003 | 0.0031 | 0.0020 | 990 | 930 |
| 35 | 0.0013 | 2.35 | 0.52 | 0.052 | 0.0014 | 0.001 | 0.0020 | 0.500 | 0.0006 | 0.0038 | 0.0001 | 0.0003 | 0.0034 | 0.0021 | 990 | 930 |
| 36 | 0.0017 | 2.35 | 0.51 | 0.052 | 0.0016 | 0.001 | 0.0020 | 0.500 | 0.0005 | 0.0006 | 0.0010 | 0.0002 | 0.0033 | 0.0023 | 990 | 930 |
| 37 | 0.0017 | 2.36 | 0.49 | 0.052 | 0.0013 | 0.001 | 0.0020 | 0.500 | 0.0004 | 0.0006 | 0.0029 | 0.0003 | 0.0032 | 0.0024 | 1000 | 940 |
| 38 | 0.0017 | 2.40 | 0.48 | 0.052 | 0.0009 | 0.001 | 0.0020 | 0.500 | 0.0003 | 0.0006 | 0.0001 | 0.0015 | 0.0036 | 0.0018 | 1000 | 940 |
| 39 | 0.0012 | 2.30 | 0.45 | 0.052 | 0.0013 | 0.001 | 0.0020 | 0.500 | 0.0006 | 0.0006 | 0.0001 | 0.0039 | 0.0031 | 0.0019 | 990 | 930 |
| 40 | 0.0017 | 2.01 | 0.49 | 0.052 | 0.0010 | 0.001 | 0.0020 | 0.500 | 0.0006 | 0.0006 | 0.0001 | 0.0003 | 0.0262 | 0.0021 | 990 | 930 |
| 41 | 0.0017 | 2.01 | 0.43 | 0.052 | 0.0015 | 0.001 | 0.0020 | 0.500 | 0.0006 | 0.0006 | 0.0001 | 0.0003 | 0.0031 | 0.0061 | 990 | 930 |
| 42 | 0.0065 | 2.01 | 0.45 | 0.052 | 0.0015 | 0.001 | 0.0020 | 0.500 | 0.0006 | 0.0006 | 0.0001 | 0.0003 | 0.0032 | 0.0018 | 980 | 920 |
| 43 | 0.0016 | 2.02 | 0.44 | 0.052 | 0.0265 | 0.001 | 0.0020 | 0.500 | 0.0006 | 0.0006 | 0.0001 | 0.0003 | 0.0030 | 0.0019 | 990 | 930 |
| 44 | 0.0017 | 2.02 | 0.04 | 0.052 | 0.0021 | 0.001 | 0.0020 | 0.500 | 0.0005 | 0.0006 | 0.0001 | 0.0002 | 0.0031 | 0.0018 | 1060 | 1000 |

| No. | Entry temp. in F1 (° C.) | Entry temp. in F7 (° C.) | Stand with dual phase | Sheet thickness (mm) | Final annealing temperature (° C.) | Grain size (μm) | HV | $W_{15/50}$ (W/kg) | $B_{50}$ (T) | Remarks |
|---|---|---|---|---|---|---|---|---|---|---|
| 1 | 1030 | 910 | — | 0.35 | 950 | 122 | 146 | 3.40 | 1.64 | Comparative Example |
| 2 | 1030 | 910 | F1 | 0.35 | 950 | 119 | 132 | 4.01 | 1.69 | Comparative Example |
| 3 | 1030 | 910 | F3, F4, F5 | 0.35 | 950 | 120 | 152 | 3.20 | 1.69 | Comparative Example |
| 4 | 1030 | 910 | F3, F4, F5 | 0.35 | 950 | 120 | 152 | 2.80 | 1.70 | Example |
| 5 | 1030 | 910 | F3, F4, F5 | 0.35 | 950 | 120 | 143 | 2.81 | 1.70 | Example |
| 6 | 980 | 860 | F1, F2, F3 | 0.35 | 950 | 120 | 156 | 2.78 | 1.69 | Example |
| 7 | 980 | 860 | F1, F2, F3 | 0.35 | 950 | 120 | 156 | 2.81 | 1.68 | Example |
| 8 | 980 | 860 | F1, F2, F3 | 0.35 | 950 | 116 | 156 | 2.96 | 1.67 | Example |
| 9 | 980 | 860 | F1, F2, F3 | 0.35 | 950 | 120 | 135 | 3.85 | 1.71 | Comparative Example |
| 10 | 980 | 860 | F1, F2, F3 | 0.35 | 890 | 69 | 150 | 4.20 | 1.71 | Comparative Example |
| 11 | 980 | 860 | F1, F2, F3 | 0.35 | 950 | 122 | 165 | 2.60 | 1.68 | Example |
| 12 | 980 | 860 | F2, F3, F4 | 0.35 | 1000 | 141 | 190 | 2.40 | 1.67 | Example |
| 13 | 980 | 860 | F2, F3, F4 | 0.35 | 1020 | 152 | 221 | 2.35 | 1.66 | Example |
| 14 | 980 | 860 | F5, F6, F7 | 0.35 | 1000 | 140 | 170 | 2.56 | 1.68 | Example |
| 15 | 870 | 750 | F6, F7 | 0.35 | 1000 | 140 | 176 | 2.80 | 1.65 | Example |
| 16 | 980 | 860 | F5, F6, F7 | 0.35 | 1020 | 141 | 285 | 2.52 | 1.60 | Comparative Example |
| 17 | 850 | 730 | F5 | 0.35 | 1000 | 142 | 175 | 3.05 | 1.63 | Comparative Example |
| 18 | 850 | 730 | F4, F5 | 0.35 | 1000 | 120 | 171 | 3.06 | 1.60 | Comparative Example |
| 19 | 1030 | 910 | F1, F2 | 0.35 | 950 | 122 | 151 | 2.80 | 1.65 | Example |
| 20 | 980 | 860 | — | 0.35 | 950 | 119 | 157 | 3.20 | 1.62 | Comparative Example |
| 21 | 980 | 860 | F1, F2 | 0.35 | 870 | 52 | 165 | 3.95 | 1.69 | Comparative Example |
| 22 | 980 | 860 | F1, F2 | 0.35 | 1100 | 210 | 135 | 3.65 | 1.65 | Comparative Example |
| 23 | 980 | 860 | F1 | 0.35 | 950 | 120 | 166 | 2.80 | 1.71 | Example |
| 24 | 990 | 870 | F1 | | fracture occurred during cold rolling | | | | | Comparative Example |
| 25 | 980 | 860 | F1, F2, F3 | 0.35 | 950 | 121 | 155 | 2.55 | 1.67 | Example |
| 26 | 980 | 860 | F1, F2, F3 | 0.35 | 950 | 121 | 155 | 2.52 | 1.65 | Example |
| 27 | 980 | 860 | F1, F2, F3 | 0.35 | 950 | 121 | 155 | 3.01 | 1.65 | Comparative Example |
| 28 | 980 | 860 | F1, F2, F3 | 0.35 | 950 | 121 | 155 | 2.57 | 1.66 | Example |
| 29 | 980 | 860 | F1, F2, F3 | 0.35 | 950 | 122 | 155 | 2.50 | 1.67 | Example |
| 30 | 980 | 860 | F1, F2, F3 | 0.35 | 950 | 117 | 170 | 2.45 | 1.67 | Example |
| 31 | 980 | 860 | F1, F2, F3 | 0.35 | 950 | 115 | 195 | 2.50 | 1.64 | Example |
| 32 | 980 | 860 | F1, F2, F3 | 0.35 | 950 | 115 | 161 | 2.65 | 1.66 | Example |
| 33 | 980 | 860 | F1, F2, F3 | 0.35 | 950 | 115 | 162 | 2.95 | 1.65 | Example |
| 34 | 980 | 860 | F1, F2 | 0.35 | 950 | 131 | 161 | 2.85 | 1.66 | Example |
| 35 | 980 | 860 | F1, F2 | 0.35 | 950 | 119 | 162 | 2.95 | 1.65 | Example |
| 36 | 980 | 860 | F1, F2 | 0.35 | 950 | 125 | 162 | 2.80 | 1.66 | Example |
| 37 | 980 | 860 | F1, F2 | 0.35 | 950 | 115 | 162 | 2.95 | 1.65 | Example |
| 38 | 980 | 860 | F1, F2 | 0.35 | 950 | 119 | 163 | 2.92 | 1.66 | Example |
| 39 | 980 | 860 | F1, F2 | 0.35 | 950 | 112 | 162 | 2.95 | 1.64 | Example |
| 40 | 980 | 860 | F1, F2 | 0.35 | 950 | 106 | 155 | 3.01 | 1.63 | Comparative Example |
| 41 | 980 | 860 | F1, F2 | 0.35 | 950 | 113 | 156 | 3.92 | 1.63 | Comparative Example |
| 42 | 980 | 860 | F1, F2 | 0.35 | 950 | 119 | 157 | 3.32 | 1.63 | Comparative Example |
| 43 | 980 | 860 | F1, F2 | 0.35 | 950 | 106 | 157 | 4.20 | 1.61 | Comparative Example |
| 44 | 990 | 870 | F1 | 0.35 | 950 | 104 | 151 | 3.36 | 1.63 | Comparative Example |

From Table 3, it can be seen that all of the non-oriented electrical steel sheets according to our examples in which the chemical composition, the $Ar_3$ transformation temperature, the grain size, and the Vickers hardness are within the scope of the disclosure are excellent in both magnetic flux density and iron loss properties as compared with the steel sheets according to the comparative examples.

INDUSTRIAL APPLICABILITY

According to the disclosure, it is possible to provide non-oriented electrical steel sheets achieving a good balance between the magnetic flux density and iron loss properties without performing hot band annealing.

REFERENCE SIGNS LIST

1 ring sample
2 V caulking

The invention claimed is:

1. A non-oriented electrical steel sheet comprising a chemical composition containing, by mass %, C: 0.0050% or less,
Si: 1.50% or more and 4.00% or less,
Al: 0.020% or less,
Mn: 0.10% or more and 5.00% or less,
S: 0.0200% or less,
P: 0.200% or less,
N: 0.0050% or less, O: 0.0200% or less, and Ca: 0.0010% or more and 0.0050% or less, with the balance being Fe and inevitable impurities, wherein the non-oriented electrical steel sheet has an $Ar_3$ transformation temperature of 700° C. or higher and 950° C. or lower, a grain size of 80 μm or more and 200 μm or less, and a Vickers hardness of 140 HV or more and 230 HV or less.

2. The non-oriented electrical steel sheet according to claim 1, wherein the chemical composition further contains, by mass %, Ni: 0.010% or more and 3.000% or less.

3. The non-oriented electrical steel sheet according to claim 1, wherein the chemical composition further contains, by mass %, Ti: 0.0030% or less, Nb: 0.0030% or less, V: 0.0030% or less, and Zr: 0.0020% or less.

4. The non-oriented electrical steel sheet according to claim 2, wherein the chemical composition further contains, by mass %, Ti: 0.0030% or less, Nb: 0.0030% or less, V: 0.0030% or less, and Zr: 0.0020% or less.

5. A method of producing the non-oriented electrical steel sheet as recited in claim 1, the method comprising performing hot rolling in at least one pass in a dual-phase region of y-phase and a-phase, thereby producing the non-oriented electrical steel sheet of claim 1.

6. A method of producing the non-oriented electrical steel sheet as recited in claim 2, the method comprising performing hot rolling in at least one pass in a dual-phase region of y-phase and a-phase, thereby producing the non-oriented electrical steel sheet of claim 2.

7. A method of producing the non-oriented electrical steel sheet as recited in claim 3, the method comprising performing hot rolling in at least one pass in a dual-phase region of y-phase and a-phase, thereby producing the non-oriented electrical sheet of claim 3.

8. A method of producing the non-oriented electrical steel sheet as recited in claim 4, the method comprising performing hot rolling in at least one pass in a dual-phase region of y-phase and a-phase, thereby producing the non-oriented electrical steel sheet of claim 4.

* * * * *